US007002433B2

(12) United States Patent
Antkowiak et al.

(10) Patent No.: US 7,002,433 B2
(45) Date of Patent: Feb. 21, 2006

(54) MICROWAVE COUPLER

(75) Inventors: Marek E. Antkowiak, Berkeley Heights, NJ (US); Andrzej Sawicki, Marsta (SE)

(73) Assignee: Microlab/FXR, Livington, NJ (US)

( * ) Notice: Subject to any disclaimer, the term of this patent is extended or adjusted under 35 U.S.C. 154(b) by 86 days.

(21) Appl. No.: 10/366,729

(22) Filed: Feb. 14, 2003

(65) Prior Publication Data

US 2004/0160291 A1 Aug. 19, 2004

(51) Int. Cl.
*H01P 5/18* (2006.01)

(52) U.S. Cl. ..... 333/116; 333/238

(58) Field of Classification Search ..... 333/10, 333/84, 112–117, 238
See application file for complete search history.

(56) References Cited

U.S. PATENT DOCUMENTS

| | | | | | |
|---|---|---|---|---|---|
| 3,560,893 | A | * | 2/1971 | Cheng | 333/24.1 |
| 3,736,535 | A | * | 5/1973 | Mohr et al. | 333/158 |
| 3,848,198 | A | * | 11/1974 | De Brecht et al. | 330/262 |
| 3,883,828 | A | | 5/1975 | Cappucci | 333/10 |
| 4,139,827 | A | * | 2/1979 | Russell | 333/116 |
| 4,313,095 | A | * | 1/1982 | Jean-Frederic | 333/116 |
| 4,394,630 | A | * | 7/1983 | Kenyon et al. | 333/116 |
| 5,063,365 | A | | 11/1991 | Cappucci | 333/121 |
| 5,075,646 | A | * | 12/1991 | Morse | 333/116 |
| 5,111,165 | A | * | 5/1992 | Oldfield | 333/116 |
| 5,521,563 | A | | 5/1996 | Mazzochette | 333/116 |
| 6,549,089 | B1 | * | 4/2003 | Ashoka | 333/116 |
| 6,624,722 | B1 | * | 9/2003 | Wang et al. | 333/116 |
| 6,822,532 | B1 | * | 11/2004 | Kane et al. | 333/116 |

FOREIGN PATENT DOCUMENTS

JP 0100619 * 3/1995

OTHER PUBLICATIONS

"*Tables For Asymmetric Chebyshev High-Pass TEM-Mode Directional Couplers*", Fritz Arndt, IEEE Transactions on Microwave Theory and Techniques, vol. MTT-18, No. 9, Sep. 1.

"*Coupled Transmission Lines*", M.A.R. Gunston,; Microwave Transmission-Line Impedance Data, Noble Publishing, 1997, pp. 230-277.

"*Ultrawideband Couplers With Continuously Varying Cross Section*" J.A.G. Malherbe, Microwave Transmission Line Couplers; Artech House 1988, pp. 134 159.

"*The High-Q Triplate Stripline*", M.A.R. Gunston Microwave Transmission-Line Impedance Data; Noble Publishing, 1997, pp. 130-143.

"*Tapered-Line Transformers*", P. A. Razzi, Microwave Engineering, Passive Circuits, Chapter 4, Prentice-Hall, 1988, pp. 152-154.

* cited by examiner

*Primary Examiner*—Dinh T. Le
(74) *Attorney, Agent, or Firm*—Darby & Darby

(57) ABSTRACT

A high power, TEM mode directional microwave coupler having low loss and expanded bandwidth uses novel thick suspended substrate conductors to provide multi-octave bandwidth performance in a practical package. Each of two center conductors is formed using metal layer deposited onto three surfaces of a thick dielectric substrate. The conductors, which can be edge-coupled or offset-coupled, form a novel structure in which the non-metallized side of the substrate is oriented toward the facing outside vertical walls. This effectively reduces the effect of the package wall on the coupling structure, permitting a smaller, constant-width dimension, which in turn raises the waveguide cut-off frequency. The result is a directional coupler with an extended high frequency performance, with reduced physical size and low loss.

12 Claims, 5 Drawing Sheets

MICROWAVE COUPLER

FIELD OF THE INVENTION

The present invention relates to microwave devices, particularly to transverse electro-magnetic (TEM) mode stripline directional couplers and to methods of making same.

BACKGROUND INFORMATION

The term "directional coupler" refers in general to a four-port passive microwave device, where a main line conductor (also called the "through" line) carries RF power. The main line conductor is in close proximity and is coupled to a secondary conductor by the electromagnetic field generated by the RF signal. The RF current flowing forward through the main line will induce RF current flow in the coupled conductor flowing in the opposite direction, and will only appear at one of the coupled ports (i.e., a signal current flowing from left to right on the main line will induce a signal current flowing from right to left in the coupled conductor and appear only from the left coupled output). As a result, the coupled output of forward and reverse flow of RF current will appear at different coupled outputs.

While it has been possible to construct TEM mode couplers operating over wide frequency ranges using stripline techniques on solid dielectrics (where the dielectric constant, also known as dielectric permeability, $E_r$>>1), it has been most difficult to do so using thick conductors in air dielectric ($E_r$=1). The inherent size of the transmission lines in air has limited usage of these components to narrow bandwidths. Known TEM mode components suffer from degradation due to non-TEM propagation, manifesting itself as resonance in the pass band of the coupler. Low power components can use microwave absorbers to suppress unwanted resonance, but at higher powers such absorbers cause passive intermodulation distortion, rendering them useless in many high power applications.

Known coupler structures include single section, multiple section and tapered designs, among others. A comprehensive summary of such structures is provided in M. A. R. Gunston, "Microwave Transmission Line Data", Noble Publishing, 1997, ISBN 1-884932-57-6. Gunston describes coupled transmission lines with coupled conductors of circular as well as rectangular cross sections. J. A. G. Malherbe, "Microwave Transmission Line Couplers", Artech House, 1988, ISBN 0-89006-300-1 describes couplers with tapered conductors.

Peter A. Razzi, "Microwave Engineering, Passive Circuits", Prentice-Hall, 1988, ISBN 0-13-586702-9 (hereinafter "Razzi") discusses the high-pass characteristics of tapered structures. The high pass performance of such couplers is explained using the equivalence principle that equates the reflection coefficient of the tapered transformer to the coupling of the corresponding tapered line coupler. This reflection has a high-pass characteristic. As discussed in Razzi, a method of changing impedance levels in a transmission system involves the use of a continuously tapered line in which the impedance of the coaxial line is gradually transformed from R1 to Zo by tapering. The input SWR remains low as long as the taper length is much greater than the operating wavelength. The higher the frequency, the better this condition is satisfied.

All of the above mentioned structures suffer from signal loss due to excess loss in the dielectric material that surrounds the conductors and to excess coupling to the enclosure walls.

U.S. Patent No. 4,139,827 ("High Directivity TEM Mode Strip Line Coupler and Method of Making the Same") uses stripline technology and adds a matching post in between the decoupled ends of the coupled conductors to increase coupler directivity.

U.S. Patent No. 5,521,563 ("Microwave Hybrid Coupler") uses microstrip technology and adds a cross-over design to the transmission lines which changes the output port.

U.S. Patent No. 5,063,365 ("Microwave Stripline Circuitry") uses two tandem connected Stripline Couplers and adds a phase shift circuit between the couplers which changes the phase relation of the output signals from 90 degrees to 180 degrees.

U.S. Patent No. 3,883,828 ("High Power Coupler Synthesis") describes the synthesis of a directional coupler using a stripline broadside-coupled transmission line in conjunction with uncoupled transmission lines (delay lines) to obtain an equivalent coupler circuit.

The above mentioned stripline and microstrip based structures suffer from signal loss due to the relatively small effective conductor cross-section areas in the coupling section and due to excess loss in the dielectric material that surrounds the conductors.

SUMMARY OF THE INVENTION

The present invention relates to TEM mode stripline directional couplers for coupling energy over a broad frequency range from a primary transmission line to a secondary transmission line with low loss and/or high directivity.

The present invention describes a method of extending the frequency bandwidth and power handling capacity of TEM mode thick strip line directional couplers by means of novel transmission line structures. In an exemplary embodiment, metallization is provided on three surfaces of a dielectric substrate having a rectangular cross-section. The arrangement of conductive surfaces on three sides of the dielectric substrate increases the effective conductor cross-section area as compared to the single layer metal conductor of a standard stripline component, thereby reducing the dissipative loss associated with the conductivity as well as reducing the coupling to the enclosure walls. The conductors may be suspended in air.

The present invention also provides practical methods for making the inventive couplers. The application of metallization on surfaces of a fiberglass substrate can be done, for example, using standard printed circuit board techniques. The present invention has the further benefits of decreased cost, simplicity, and accurate repeatability.

A result of the aforementioned aspects of the present invention is a directional coupler with exceptional bandwidth, very low dissipative loss and high power rating. The couplers of the present invention also enjoy a lower manufacturing cost than equivalently performing conventional structures.

DETAILED DESCRIPTION

Figure 1:
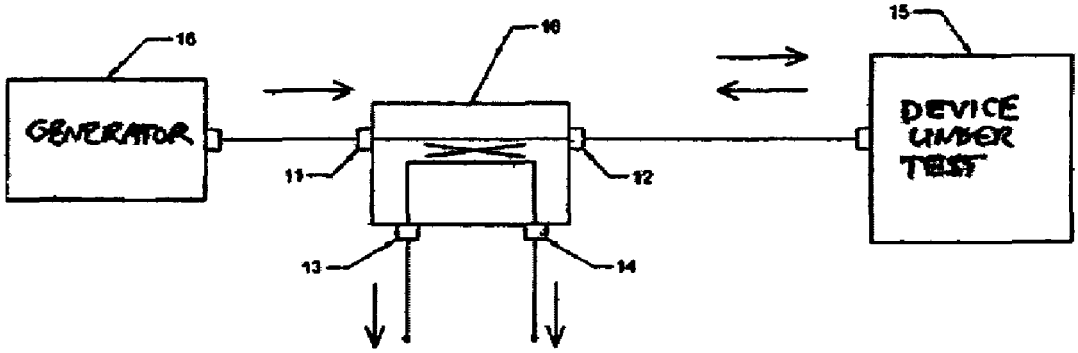
FIG. 1 shows an exemplary application for a coupler of the present invention.

FIG. 1 shows an exemplary directional coupler 10 used in a typical application. In the application illustrated, the coupler 10 is used in a test setup to monitor the signal levels of forward and reflected power for a device under test 15. The coupler 10 comprises an input port 11 which is coupled to the output of an RF generator 16 and an output port 12 which is coupled to the device under test 15. The coupler 10 provides at a first coupled output port 13 a signal which is a predetermined fraction of the forward signal flowing from the RF generator 16 to the device under test 15. The coupler also provides at a second coupled output port 14 a signal which is a predetermined fraction of any reflected signal flowing back from the device under test 15 to the RF generator 16. Ideally, none of the reflected power appears at the first coupled output port 13 and none of the forward power appears at the second coupled output port 14.

Figure 2A:
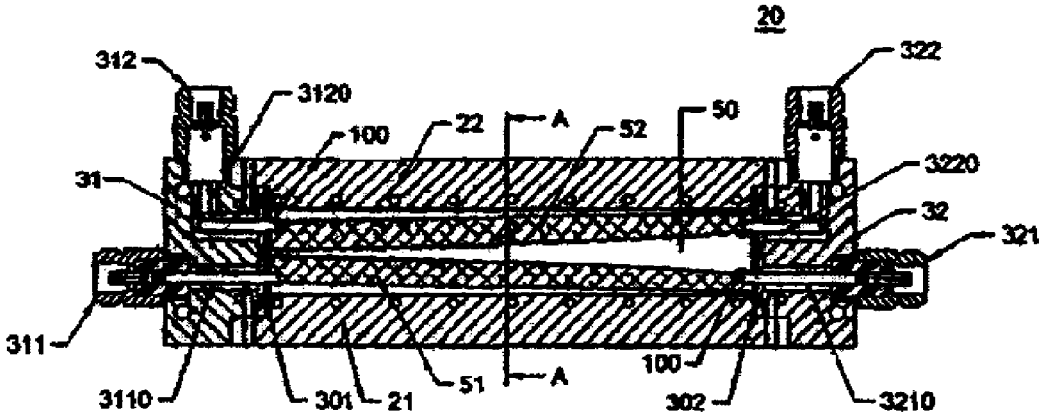
FIGS. 2A and 2B are plan and cross-section views, respectively, of a first exemplary embodiment of a coupler in accordance with the present invention.
Figure 2B:
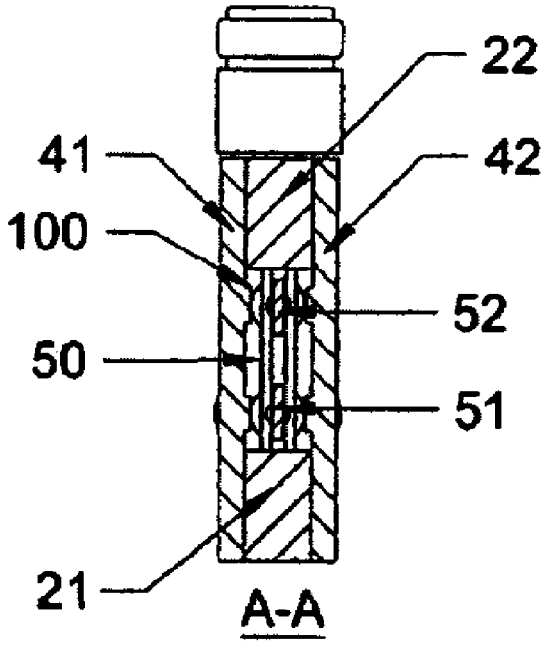

FIG. 2A is a plan view of a first exemplary embodiment of a coupler device 20 in accordance with the present invention. FIG. 2B is a view along the section A—A of FIG. 2A. As can be seen in FIGS. 2A and 2B, the coupler device 20 comprises a housing which includes first and second side rails 21 and 22, end blocks 31 and 32 and covers 41 and 42. The first and second side rails 21 and 22 are substantially parallel to each other and are each attached at opposite ends to the end blocks 31 and 32. Covers 41 and 42 extend between the side rails 21, 22 and the end blocks 31, 32. A cavity 50 is delimited by the side rails 21, 22, end blocks 31, 32 and covers 41, 42. The cavity 50 may be occupied by dielectric material, such as air, a gas or vacuum. Using an air, gas or vacuum dielectric in the coupler of the present invention minimizes the transmission loss of the coupler associated with the microwave dielectric loss tangent.

The housing comprised of the side rails 21, 22, end blocks 31, 32 and covers 41, 42 acts as an outer conductor of the coupler 20. In an exemplary embodiment, each of the aforementioned elements is formed from aluminum, metal or other material with a suitable electrically conductive surface. Such surface can be obtained by electrically conductive coating or enhancement of the surface. In general, the coupler of the present invention includes conductive as well as non-conductive materials. The conductive materials may include brass, aluminum, beryllium copper, etc. and may be protected against corrosion using electrically conductive plating (e.g., silver plating) or chemical conversion coating (iridite).

A first connector 311 and a second connector 312 are mounted on the end block 31 and a third connector 321 and a fourth connector 322 are mounted on the end block 32. In an exemplary arrangement, the connector 311 acts as an input port, the connector 321 acts an output port, the connector 312 acts as a forward power coupled port and the connector 322 acts as a reverse power coupled port. In operation, as described above with reference to FIG. 1, a proportion of the forward power conducted from the first connector 311 to the second connector 312 appears at the third connector 312 and a proportion of the reverse power conducted from the second connector 312 to the first connector 311 appears at the fourth connector 322.

The connectors 311, 312, 321 and 322 can be RF-type connectors or the like. The bodies of the connectors 311, 312, 321 and 322 are attached to and make conductive contact with the end blocks 31 and 32 which in turn are attached in conductive contact with side rails 21, 22 and covers 41, 42.

The center contacts of the connectors 311 and 321 are each coupled to opposite ends of a first conductor 51 which is suspended within the cavity 50. Similarly, the connectors 312 and 322 are each coupled to opposite ends of a second conductor 52 which is also suspended within the cavity 50. The first conductor 51 may also be referred to as the primary transmission line because it interconnects the input and output ports of the main line, whereas the second conductor 52 may also be referred to as the secondary transmission line because it interconnects the coupled ports.

The conductors 51 and 52 are generally elongate and planar and have tapered profiles. In the exemplary embodiment of FIGS. 2A and 2B, the conductors 51 and 52 are substantially co-planar, as shown in FIG. 2B. The tapered profiles of the conductors 51 and 52 are characteristic of high pass coupler structures. The width of each conductor is non-uniform and varies along the length of the conductor. The conductors 51 and 52 may have similar or different profiles.

In the exemplary embodiment shown, the conductors 51, 52 are coupled via segments of coaxial transmission line 3110, 3120, 3210 and 3220 to the center contacts of the connectors 311, 312, 321 and 322, respectively. The segments 3110, 3120, 3210 and 3220 may also be referred to as feed lines. The transmission line segments 3110, 3120, 3210 and 3220 are routed through channels in the end blocks 31 and 32. The transmission line segments 3110, 3120, 3210 and 3220 are supported by dielectric supports 301, 302 proximate to the points of connection with the conductors 51 and 52 so as to prevent contact between the conductors 51, 52 and the surrounding housing (21, 22, 31, 32, 41, 42) and between the transmission line segments and the surrounding housing.

Figure 3A:
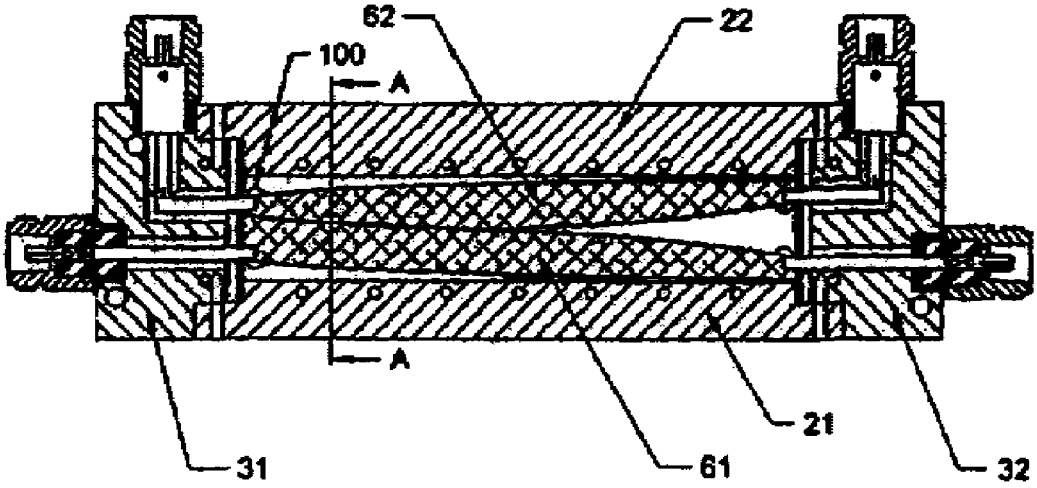
FIGS. 3A and 3B are plan and cross-section views, respectively, of a second exemplary embodiment of a coupler in accordance with the present invention.
Figure 3B:
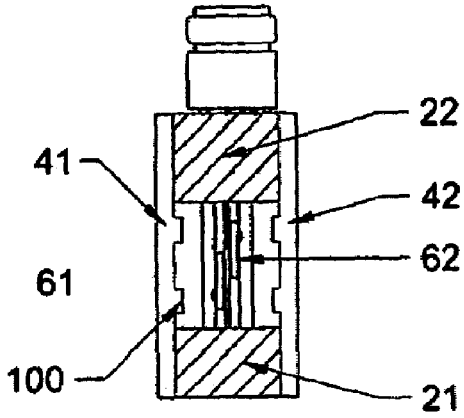

A second exemplary embodiment of a coupler in accordance with the present invention is shown in FIGS. 3A and 3B. The two embodiments are merely exemplary subsets of the invention. Each embodiment illustrates the claims by displacement of the secondary transmission line in either the vertical plane or the horizontal plane relative to the primary transmission line. Whereas displacement of the secondary transmission line relative to the primary transmission line can be any combination of vertical and horizontal displacement, displacement as shown in FIG. 3B may be necessary when tight coupling is required. FIG. 3A is a plan view of the second exemplary embodiment of a coupler device 20 in accordance with the present invention whereas FIG. 3B is a view along the section A—A of FIG. 3A. Similar components are numbered similarly.

In the embodiment of FIGS. 3A and 3B, the primary and secondary transmission line conductors 61 and 62 are not coplanar, but rather are in substantially parallel, but separate planes, as can be seen in FIG. 3B. Moreover, as seen from a direction normal to the planes of the conductors (i.e., the plan view of FIG. 3A), there is some overlap between the conductors for at least a portion of their lengths. Furthermore, though generally tapered, the conductors 61 and 62 may have profiles that are different from those of the conductors 51, 52 of the first embodiment.

To improve the impedance matching and directivity of the coupler of the present invention, the embodiments shown in FIGS. 2A, 2B and 3A, 3B include structures 100, referred to as tuning posts, arranged on the inner surfaces of the covers 41 and 42. As shown, the tuning posts 100 can be implemented as generally cylindrical protrusions on the inner surfaces of the covers 41 and 42 located proximate to the points at which the feed line segments 3110, 3120, 3210 and 3220 are connected to the conductors 51, 52 (or 61, 62). There are four tuning posts 100 in the embodiments shown, one for each connection.

The points at which the feed line segments 3110, 3120, 3210 and 3220 connect to the conductors may also be referred to as "diverging points." Each diverging point is a transition from the coupled to the uncoupled region of the coupler. The line feed line segments 3110, 3120, 3210 and 3220 are generally round, coaxial elements whereas the conductors 51, 52 (61, 62) are generally flat. This discontinuity creates performance degradation which the tuning posts 100 help to eliminate or reduce by adding capacitance in the transition region so as to yield a substantially constant impedance along the transition. The amount of capacitance added by each tuning post 100 can be controlled by appropriately selecting the diameter and height of the post.

Figure 4:
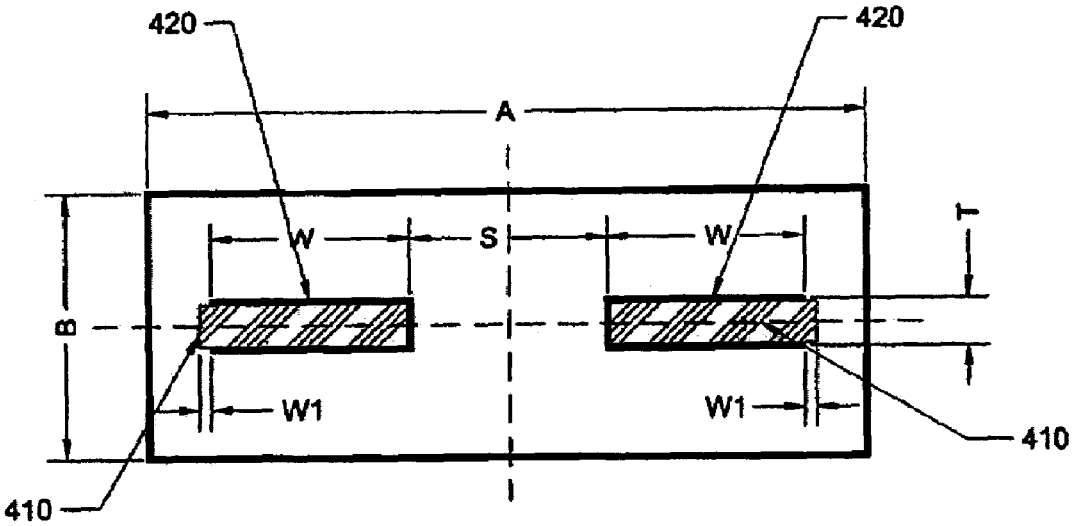
FIG. 4 is a view of a cross section of the first exemplary embodiment of a coupler in accordance with the present invention illustrating the relevant cross-sectional dimensions.
Figure 5:
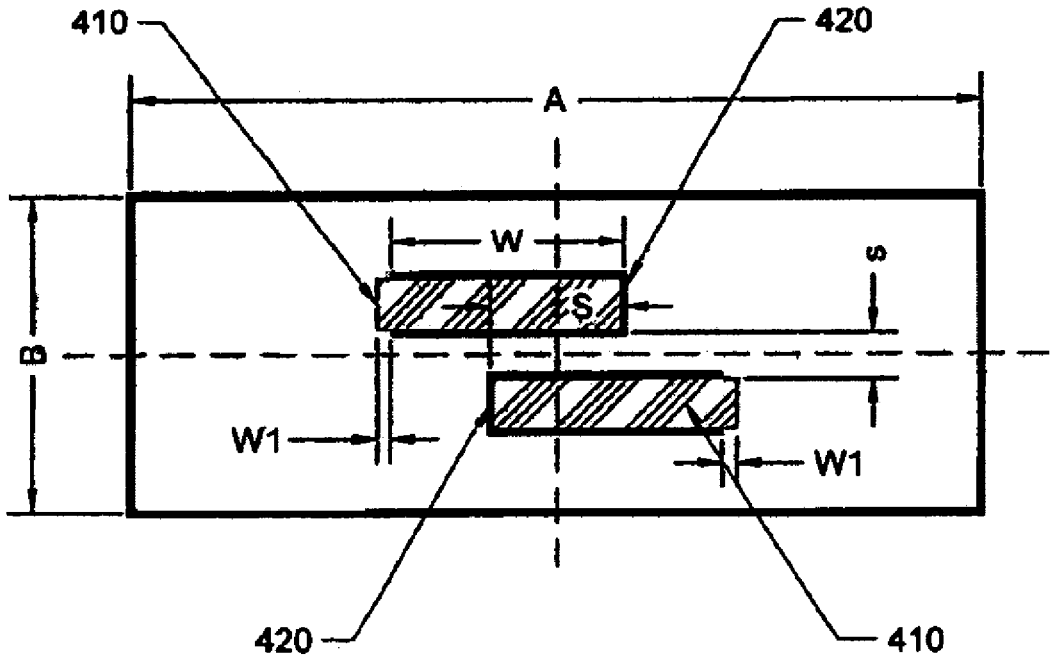
FIG. 5 is a view of a cross section of the second exemplary embodiment of a coupler in accordance with the present invention illustrating the relevant cross-sectional dimensions.

The design of the conductors 51, 52 and 61, 62 will now be described in greater detail with reference to FIGS. 4 and 5. Each of the conductors 51, 52 and 61, 62 comprises a substrate 410 that is at least partially covered by one or more layers of metallization 420. In the exemplary embodiment shown in which each conductor has a rectangular cross-section, the metallization 420 covers the surface of the substrate which faces the opposite conductor (i.e., the inner surface) and a portion of each of the adjacent (top and bottom) surfaces. As can be seen in FIGS. 4 and 5, the metallization 420 has a generally U-shaped cross section. The metallization 420 on the top and bottom surfaces increases the equivalent conductor cross-section and increases the power rating of the coupler as compared to single strip designs (e.g., stripline, microstrip). The metallization 420 on the inside, vertical, surfaces increases the coupling between the lines (tighter coupling values). These features allow the couplers of the present invention to enjoy power and coupling ranges similar to equivalent solid conductor structures. Due to skin effects at higher frequency, however, most of the current flows through the metal region close to the conductor surface thereby allowing the U-shaped metallization of the present invention to replace solid conductors without sacrificing performance. By comparison, conventional couplers using stripline technology, where the thickness of the flat conductors is very small (e.g., 0.0007"), suffer low power rating and loose coupling values. Such problems are avoided by the coupler of the present invention.

The substrate 410 may comprise a microwave substrate, fiberglass, or other suitable dielectric. The metallization may comprise copper or other suitable conductor.

The conductors 51, 52 and 61, 62 can be manufactured using conventional techniques. For example, each conductor can be etched from a copper-clad dielectric sheet that is then edge plated, etched and routed to the desired dimensions and shape.

The arrangement of metallization on three sides of the dielectric substrate increases the effective conductor cross-section area as compared to the single-layer metal conductors of standard stripline components. This increases the DC and RF average power carrying capacity of the transmission line thus formed and reduces the dissipative loss associated with conductivity. Dissipative loss includes all losses inside the coupler and has three components: ohmic (associated with the resistance of conductors), dielectric (associated with the dissipation factor or loss tangent of the dielectric substrate), and radiation loss (energy escaping into open air). The couplers of the present invention essentially have only ohmic losses, whereas stripline and microstrip couplers have significant dielectric losses as well.

In an exemplary embodiment, a coupler in accordance with the present invention has an insertion loss of typically less than 0.1 dB, which generally allows a higher power rating (e.g., hundreds of watts CW). This compares to stripline, microstrip or suspended-stripline couplers, which have insertion losses of 0.5 dB and power ratings of tens of watts. Such designs use a single metal conducting layer on a substrate material, which has losses much greater than air and a thick conductor.

The high pass characteristic of the exemplary couplers of the present invention is limited at high frequencies by the influence of other propagation modes and housing resonance which are functions of the distance between the side rails 21 and 22. For example, capacitive coupling between the conductors and the side rails causes a roll-off in the high pass characteristic at high frequencies. By not including metallization on the surfaces of the conductors 51, 52 (61, 62) that face the rails 21, 22, the capacitive coupling of each conductor to the respective rail is reduced.

Furthermore, the cavity 50 delimited by the two side rails 21, 22 and covers 41, 42 acts as the coupled region of the coupler. The size of the cavity 50 affects the top operational frequency of the coupler; i.e., the larger the cavity, the lower the operational frequency (or resonant frequency) of the coupler. This is undesirable since it limits the bandwidth of the coupler. Using conductors (51, 52, 61, 62) having a non conductive surface facing the side rails reduces the effect of side wall proximity. Coupling to the side walls is reduced, thereby making it possible to bring the side walls closer to each other and thus increasing the high frequency cut-off of the coupler.

As a result, a coupler in accordance with the present invention has performance in power and coupling values that is comparable to solid conductor structures, yet a high-end cut-off frequency comparable to single conductor structures.

The coupling between conductors 51 and 52 (or 61 and 62) is achieved due to the proximity of the two conductors. The proximity of the two conductors at each point along the length of the conductors can be characterized by a mathematical function. In a preferred embodiment, the coupler of the present invention uses non-linearly tapered conductors such as described in J. A. G. Malherbe, "Microwave Transmission Line Couplers", Artech House, 1988, ISBN 0-89006-300-1 (hereinafter "Malherbe"). As a result of the tapered profile of the conductors, the coupling value between the conductors decreases continuously from the tight-coupled end (i.e., the end proximate to the input) to the loose-coupled end (i.e., the end proximate to the output) of the coupler. Notice that the couplers are passive components and the transmission properties are therefore reciprocal, meaning ideally identical when the input and output ports are reversed. The taper can also be symmetrical, i.e. get smaller (or bigger) at the middle and be the same size at each end. Such tapered structures have high pass characteristics which contribute to the extended frequency performance of the coupler of the present invention as compared to conventional single or multiple quarter-wavelength transmission line couplers which are generally band-pass structures.

Malherbe provides a mathematical expression of the coupling variation across the length of the coupler along the coupled region. This coupling is used to design the coupler conductors using available "coupled transmission line" structures. Given the coupling variation across the length of the conductors, the required coupling coefficient, characteristic impedance and side wall proximity, the width of each conductor and the spacing between conductors can be determined using commonly available computer simulation tools known as static field solvers and the following procedure.

FIGS. 4 and 5 indicate the relevant cross-sectional dimensions of the conductors and the surrounding housing. The length is first selected to be close to or larger than the minimum length required, commonly a quarter of a wavelength, for operation at the lowest frequency of intended coupling. The width (A) and height (B) of the cavity 50 are selected to be less than or close to the width and height which prevent undesirable electromagnetic modes of propagation, commonly less than a quarter of a wavelength at the highest frequency of intended controlled coupling. The thickness (T) of each conductor (51, 52, 61, and 62) is preferably selected in accordance with the range of substrates commercially available, i.e. 0.010, 0.020, 0.031 inches. The thickness (t) of the metallization is selected to be close to or greater than the depth of electromagnetic wave penetration (skin effect) at the lowest frequency of intended coupling. The distance (W1) between the outer edge of each conductor and the outer edges of the metallization, or dielectric overhang, is selected as a small but practical number allowed by the chosen performance tolerances and manufacturing process.

Having selected A, B, T, t, W1 and knowing the dielectric constant and loss tangent of the chosen substrate material, one can calculate corresponding values for the width of the metallization (W) and the spacing (S) between the inner edges using coupling variation data provided in Fritz Artndt; "Tables for Asymmetric Chebyshev High-Pass TEM-Mode Directional Couplers", IEEE Transactions on Microwave Theory and Techniques, Vol. MTT-18, NO 9, September 1970 (hereinafter "Arndt"). Arndt provides tables which show the variation of coupling coefficient values over the length of the coupling conductors for various values of total coupling expressed in 3, 6, 8.34, 10 and 20 dB. These tables can be used to determine coupling coefficient values across the length of the coupler and in turn the spacing (S) between the conductors and the width (W) of the metallization on each conductor for various points along the length of the coupler Exemplary dimensions for a 20 dB directional coupler are shown in the following table.

| Dimension | Proximate to input end of coupler | Proximate to output end of coupler |
|---|---|---|
| A | .900" | |
| B | .334" | |
| T | .060" | |
| t | .0014" | |
| W1 | .005" | |
| S | .071" | .463" |
| W | .278" | .184" |

As shown in the above table, the housing cavity width and height (A=0.334", B=0.900"), substrate thickness (T=0.060"), metallization thickness (t=0.0014") and dielectric overhang (W1=0.005") are substantially constant throughout the length of the coupler, whereas the conductor spacing (S) and the metallization width (W) vary along the length of the conductors between the values listed above. The length of the conductors in this exemplary embodiment is 5.163".

An exemplary coupler of the present invention with the aforementioned dimensions has a bandwidth of 700 MHz to 4 GHz (a 5.7:1 ratio). This is a substantially wider frequency range than comparably sized quarter-wavelength couplers whose bandwidth is determined by the number of sections employed. For example, a single section quarter-wavelength coupler will have a one octave bandwidth. A single section quarter-wavelength coupler with a bandwidth of 700 to 1,400 MHz is approximately the same size as the aforementioned 700 to 4,000 MHz coupler of the present invention.

The present invention is not to be limited in scope by the specific embodiments described herein. Indeed, various modifications of the invention in addition to those described herein will become apparent to those skilled in the art from the foregoing description and the accompanying figures. Such modifications are intended to fall within the scope of the appended claims.

It is further to be understood that all values are to some degree approximate, and are provided for purposes of description.

The disclosures of any patents, patent applications, and publications that may be cited throughout this application are incorporated herein by reference in their entireties.

What is claimed is:

1. A directional coupler comprising:

a housing, the housing forming an outer conductor;

a dielectric within said housing, wherein the dielectric is air, gas or vacuum;

a primary transmission path including a primary transmission line disposed in a first plane within said dielectric; and a secondary transmission path including a secondary transmission line disposed in a second plane within said dielectric and having a portion in coupling proximity with said primary transmission line to form a continuously coupled section, wherein the first and second planes are substantially parallel or coplanar and each of the primary and secondary transmission lines includes a dielectric substrate having a conductor on three surfaces of the dielectric substrate.

2. The coupler of claim 1, wherein the coupler operates in a transverse electromagnetic mode (TEM).

3. The coupler of claim 1, wherein one of the three surfaces of the dielectric substrate is substantially perpendicular to another of the three surfaces of the dielectric substrate.

4. The coupler of claim 1, wherein one of the three surfaces of the dielectric substrate of the primary transmission line generally faces the secondary transmission line.

5. The coupler of claim 1, wherein a fourth surface of the dielectric substrate of the primary transmission line does not have the conductor thereon, the fourth surface generally facing away from the secondary transmission line.

6. The coupler of claim 1, wherein the continuously coupled section includes a loosely coupled end and a tightly coupled end, a coupling coefficient varying continuously along the coupled section between the loosely coupled and tightly coupled ends.

7. The coupler of claim 1, wherein the housing includes:

top and bottom walls substantially parallel to the first and second planes; and side walls substantially perpendicular to the first and second planes.

8. The coupler of claim 1, wherein the outer conductor is in proximity to the coupled section and influences a characteristic impedance of the coupler.

9. The coupler of claim 1, wherein the housing includes a tuning post proximate to a diverging point of at least one of the primary and secondary transmission paths.

10. The coupler of claim 9, wherein the tuning post comprises a generally cylindrical protrusion on an inner surface of the housing.

11. The coupler of claim 1, wherein one of the three surfaces of the dielectric substrate of the secondary transmission line generally faces the primary transmission line.

12. The coupler of claim 1, wherein a fourth surface of the dielectric substrate of the secondary transmission line does not have the conductor thereon, the fourth surface generally facing away from the primary transmission line.

* * * * *

UNITED STATES PATENT AND TRADEMARK OFFICE

CERTIFICATE OF CORRECTION

PATENT NO. : 7,002,433 B2
APPLICATION NO. : 10/366729
DATED : February 21, 2006
INVENTOR(S) : Marek E. Antkowiak et al.

It is certified that error appears in the above-identified patent and that said Letters Patent is hereby corrected as shown below:

On the title page item (73), Delete

"Microlab/FXR, Livington, NJ (US)" and substitute

-- Microlab/FXR, Livingston, NJ (US) --.

Signed and Sealed this

Sixth Day of February, 2007

JON W. DUDAS
*Director of the United States Patent and Trademark Office*